US005966098A

United States Patent [19]

Qi et al.

[11] Patent Number: 5,966,098

[45] **Date of Patent: *Oct. 12, 1999**

[54] ANTENNA SYSTEM FOR AN RF DATA COMMUNICATIONS DEVICE

[75] Inventors: Yihong Qi; Lizhong Zhu, both of Waterloo; Peter J. Edmonson, Hamilton; Perry Jarmuszewski, Guelph; Steven Carkner, Waterloo, all of Canada

[73] Assignee: Research In Motion Limited, Waterloo, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/715,347

[22] Filed: Sep. 18, 1996

[51] Int. Cl.[6] ..... H01Q 1/24

[52] U.S. Cl. ..... 343/702; 343/806; 343/821; 343/822

[58] Field of Search ..... 343/702, 718, 343/806, 803, 821, 822; H01Q 1/24

[56] References Cited

U.S. PATENT DOCUMENTS

| | | | |
|---|---|---|---|
| 3,599,214 | 8/1971 | Altmayer | 343/724 |
| 4,571,595 | 2/1986 | Phillips et al. | 343/702 |
| 5,245,350 | 9/1993 | Sroka | 343/702 |
| 5,684,672 | 11/1997 | Karidis et al. | 343/702 |

OTHER PUBLICATIONS

PCT International Preliminary Examination Report, Dec. 23, 1998.

*Primary Examiner*—Michael C. Wimer
*Attorney, Agent, or Firm*—Jones, Day, Reavis & Pogue; Charles B. Meyer, Esq.

[57] ABSTRACT

An RF data communications device antenna system is shown that includes a dipole and an electromagnetic coupler that provides coupling between each dipole arm to establish a desired resonant bandwidth. An LC matching circuit is provided for matching the dipole to the impedance of the RF data communications device and for transforming the RF signal between the dipole arms of the antenna system.

12 Claims, 9 Drawing Sheets

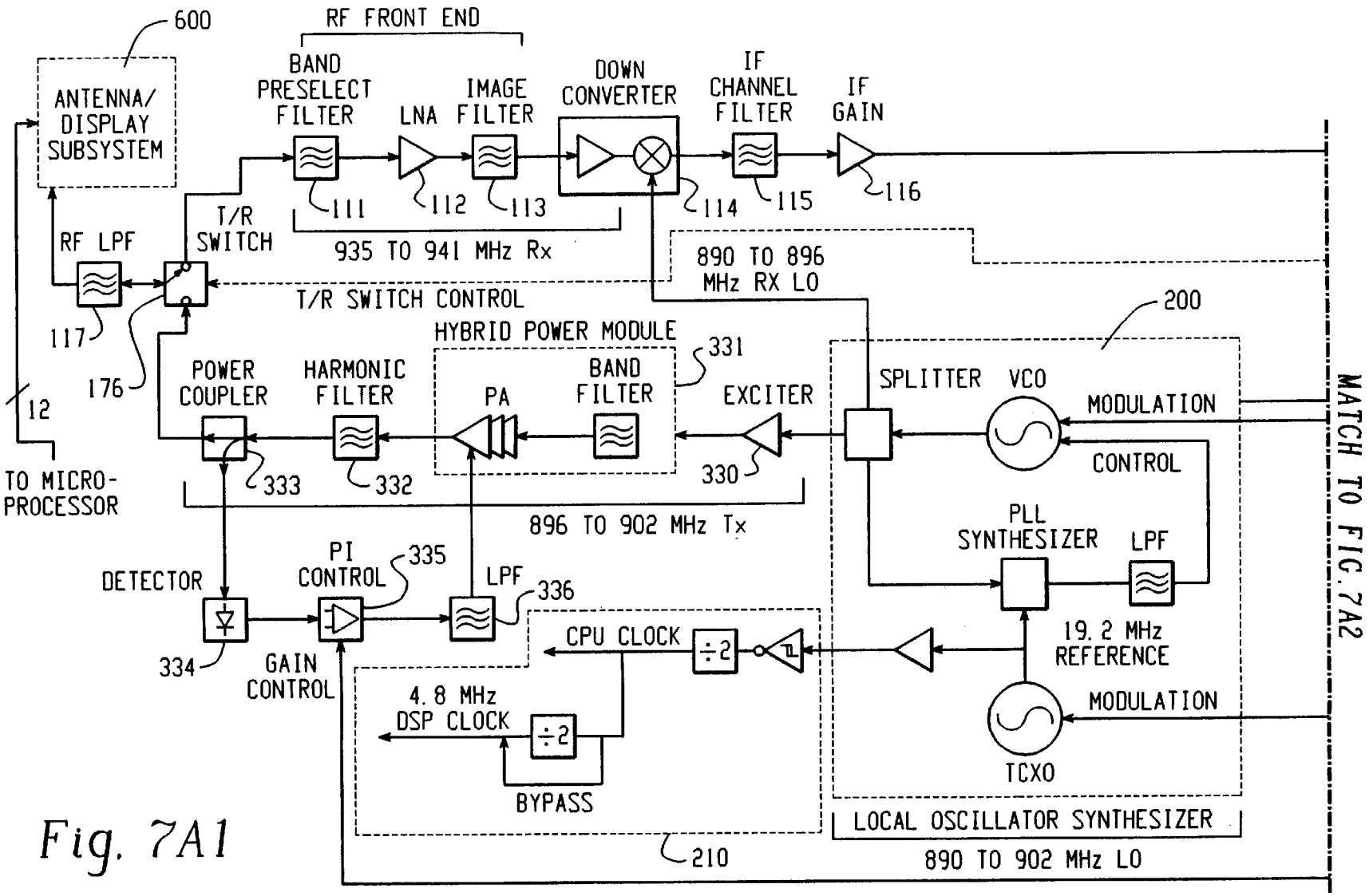
Fig. 7A1

Fig. 7A2
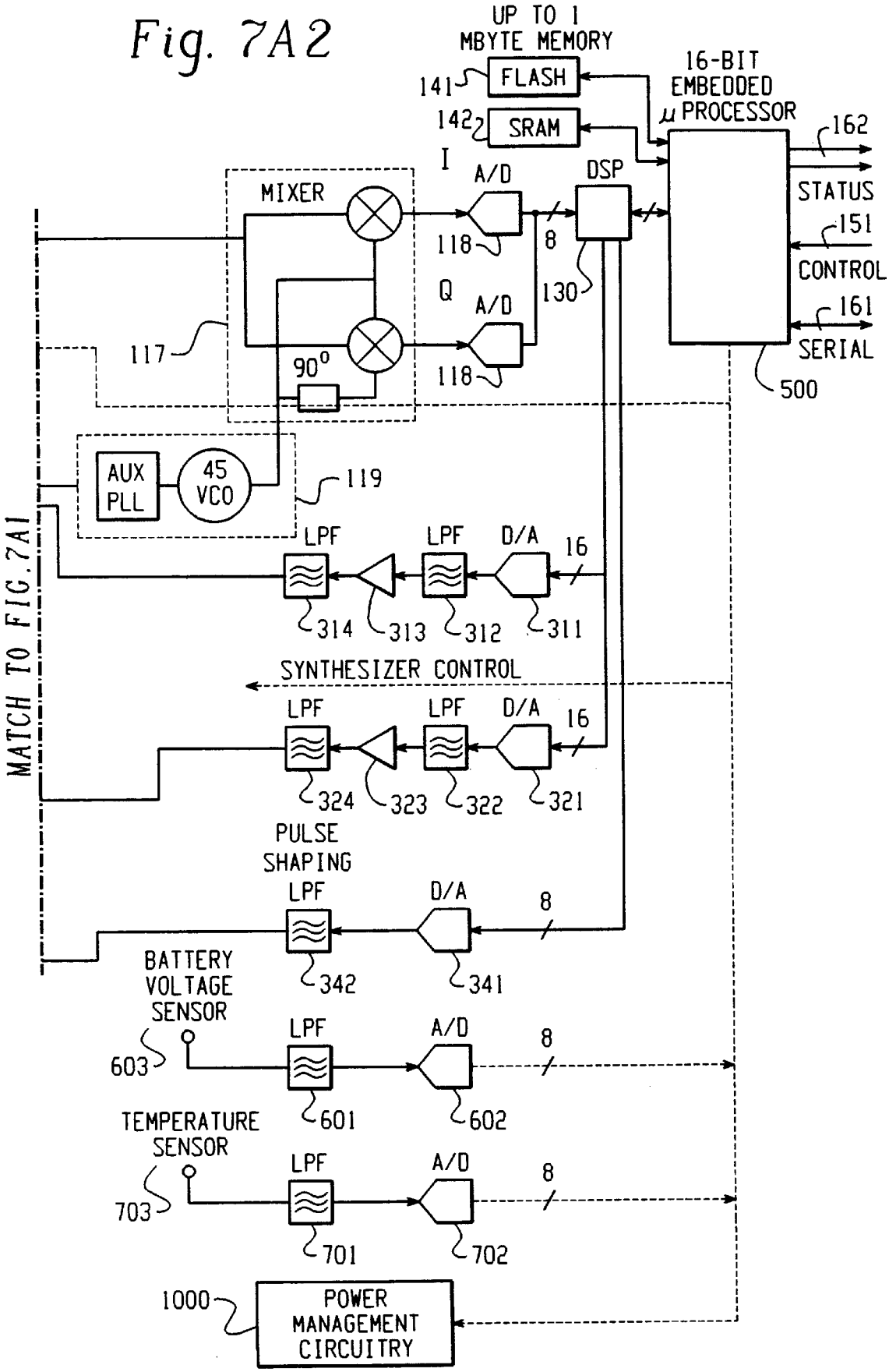

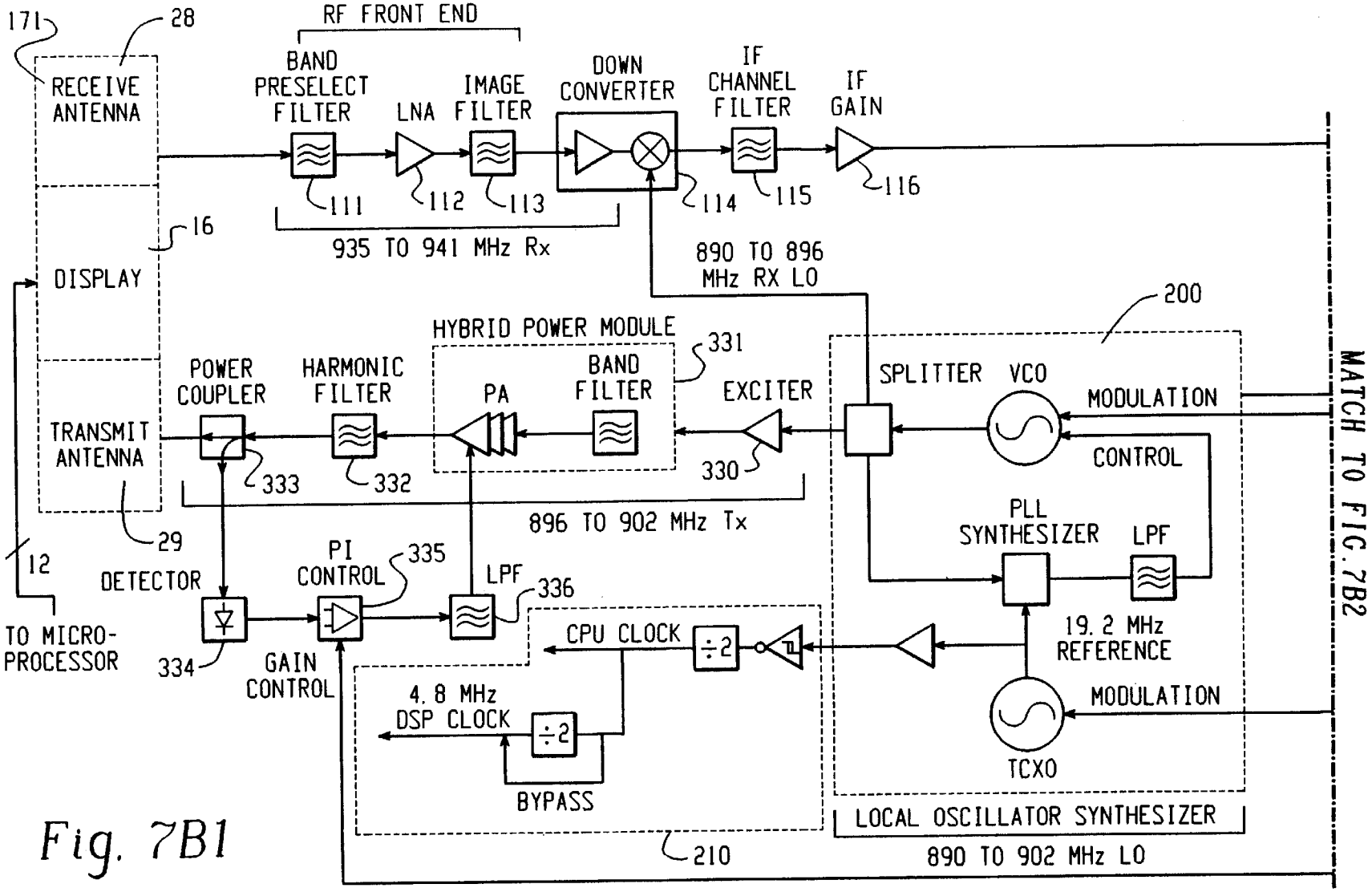
Fig. 7B1

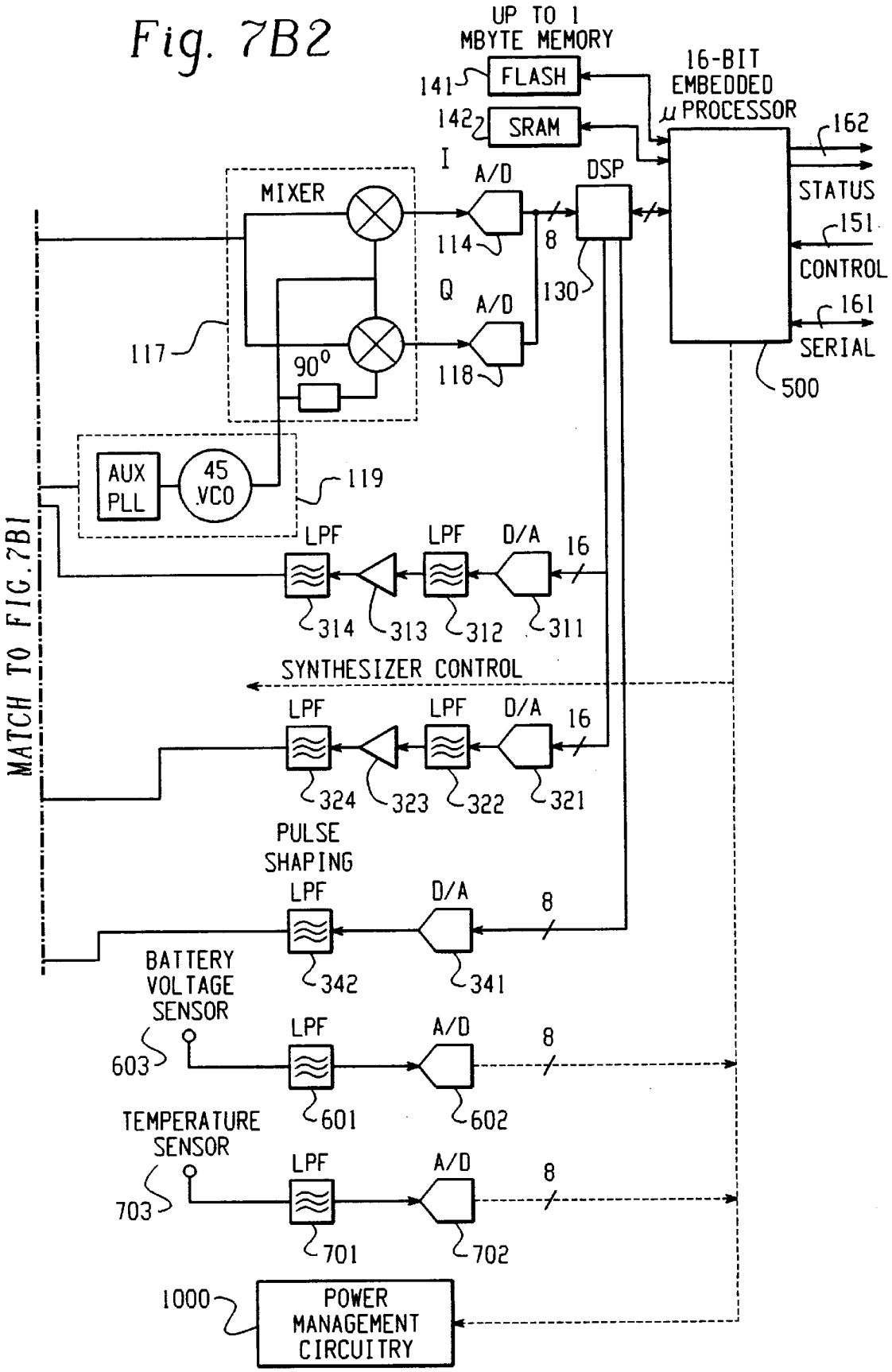
Fig. 7B2
UP TO 1 MBYTE MEMORY
FLASH
SRAM
141
142
16-BIT EMBEDDED μ PROCESSOR
162
STATUS
151
CONTROL
161
SERIAL
500
MIXER
I
A/D
DSP
114
8
130
Q
A/D
118
117
90°
AUX PLL
45 VCO
119
MATCH TO FIG.7B1
LPF
LPF
D/A
16
314
313
312
311
SYNTHESIZER CONTROL
LPF
LPF
D/A
16
324
323
322
321
PULSE SHAPING
LPF
D/A
8
342
341
BATTERY VOLTAGE SENSOR
603
LPF
A/D
8
601
602
TEMPERATURE SENSOR
703
LPF
A/D
8
701
702
1000
POWER MANAGEMENT CIRCUITRY

ANTENNA SYSTEM FOR AN RF DATA COMMUNICATIONS DEVICE

BACKGROUND OF THE INVENTION

The present invention is directed to the field of antennas used for RF data communications devices, particularly those used to transmit and receive digital signals, e.g. two-way pagers and the like. There has been a proliferation in recent years in the field of RF telecommunications with items such as cordless and cellular telephones becoming commonplace items. Pagers, in particular, have become common among individuals who need to be quickly contacted from remote locations, e.g. technicians, etc. With such devices, it is very important to maintain a clear, strong signal that preserves the integrity of the data transmission.

The antennas used with previous RF data communication devices are prone to many significant problems. Some devices, such as pagers are usually worn on the person of the user. However, the human body has certain inherent dielectric properties (e.g. due to charge and current fluctuations, etc.) that create an electromagnetic boundary. The inherent boundary conditions of the body of the user changes the surrounding impedance, affecting the antenna current distribution and the signal radiation pattern, thus lowering the gain of the antenna by about 4 dB. In this way, the antenna is "detuned." Antenna detuning is also caused by the presence of certain objects (e.g. metallic bodies) and also various ground plane conditions. This effect results in a shorter operating radius and poor in-building performance for RF data communications devices, especially pagers.

Previous devices also suffer from performance problems related to the polarization characteristics of the transmission and reception signals. Electromagnetic radiation propagates in any plane and can thus be regarded as having vertical and horizontal polarizations. In order to receive a strong signal, an antenna must be properly aligned with the polarization plane of the incoming signal. However, when a device is in operation, it may be turned in all different directions and may not be optimally aligned to receive an incoming signal. In a two-way device, a similar problem results in transmission from the device. Previous device antennas incorporate a loop design, which is nominally effective at implementing the two polarizations but suffers from low gain and low bandwidth. Environmental sources also affect the reception of a polarized signal. For example, the metal in buildings effectively "tips" a vertically polarized wave, thus weakening the strength of a signal received with a vertically polarized antenna.

One method of addressing the above-noted limitations imposed by signal reception in an RF data communications device, such as a pager, is to establish two-way communication, so that an acknowledgment or reply signal is transmitted from the pager back to the source. However, because these devices are usually worn or used in close proximity to the user's body, the electromagnetic boundary around the user's body also sharply reduces transmission efficiency. Also, transmission bandwidths as low as ½% are typical with previous two-way pagers. In these ways, the antennas of previous RF data communications devices do not provide the reliable and efficient operation necessary for the transmission and reception of a digital signal.

SUMMARY OF THE INVENTION

In view of the difficulties and drawbacks associated with previous antennae for RF data communication devices, it would be advantageous to provide an antenna system that solves the previous problems by implementing a more reliable and efficient antenna design.

Therefore, there is a need for an improved antenna system that provides an RF data communications device with an increased operating radius.

There is also a need for a for an improved antenna system that provides a two-way data communication device with improved in-building performance.

There is also a need for an antenna system that renders an RF data communications device less sensitive to environmental fluctuations.

There is also a need for an antenna system that enables an RF data communications device to operate with less sensitivity to directional position.

There is also a need for an RF data communications device that provides stable, high gain, two-way data communication.

There is also a need for a antenna system that permits simultaneous transmission and receipt of data in an RF data communications device.

There is also a need for a method of improving transmission and reception through an antenna system used in conjunction with an RF data communications device.

These needs and others are realized by the antenna of the present invention, which preferably includes a dipole having two substantially orthogonal elements for receiving and transmitting an electromagnetic signal. An electromagnetic coupling is used to balance the signal strength between each dipole element to establish a desired resonant bandwidth. An impedance matching circuit, preferably in the form of an LC lumped matching circuit is provided including at least one capacitor and at least one inductor for electrically connecting the dipole to the data communications device.

As will be appreciated, the invention is capable of other and different embodiments, and its several details are capable of modifications in various respect, all without departing from the invention. Accordingly, the drawings and description are to be regarded as illustrative in nature and not restrictive.

BRIEF DESCRIPTION OF THE DRAWINGS

The embodiments of the invention will now be described by way of example only, with reference to the accompanying figures wherein the members bear like reference numerals and wherein:

FIG. 7A is a diagram of an RF data communications device utilizing a single antenna configuration according to the present invention.

FIG. 7B is a diagram of a RF data communications device utilizing a dual antenna configuration according to the present invention.

DETAILED DESCRIPTION OF THE INVENTION

Figure 1A:
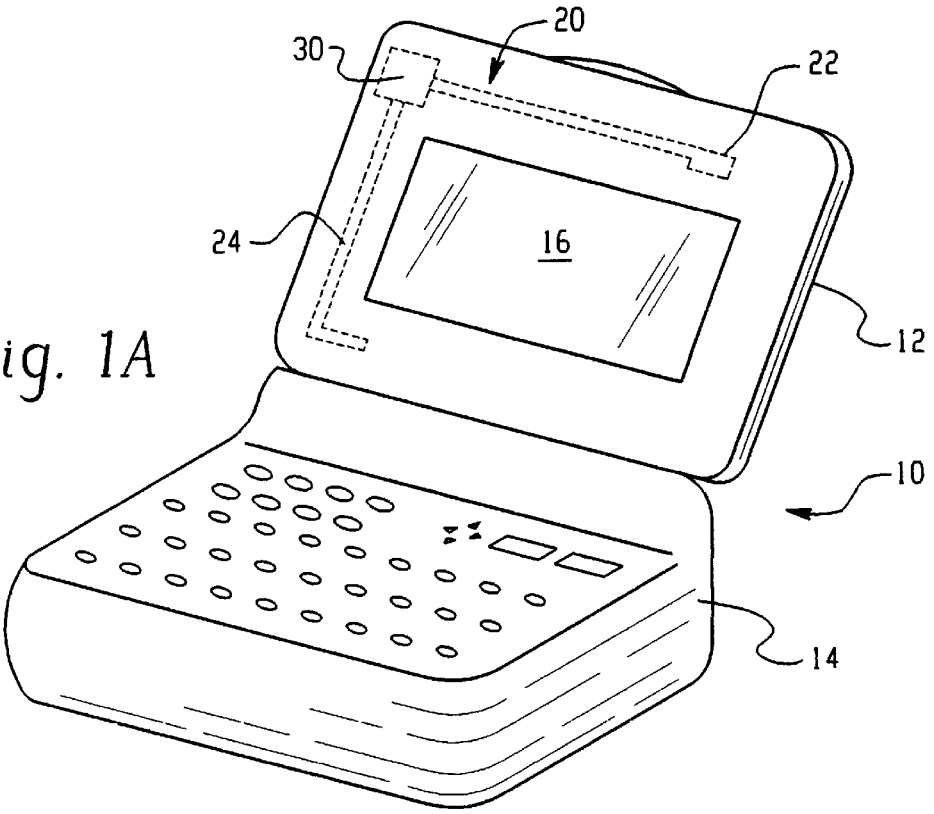
FIG. 1*a* shows a hand-held data communications device having a single antenna as according to the present invention.

Referring now to the drawings, which are for purposes of illustrating only preferred embodiments of the present invention and not for purposes of limiting the same, the figures show one embodiment of the invention wherein a single dipole antenna having an electromagnetic coupling and an LC impedance matching circuit that provides an unbalanced to balanced transformation. A second embodiment illustrating the use of a dual antenna configuration is also shown. The antenna, whether alone or as part of a dual antenna configuration, is especially suited for transmitting and receiving in a range of 800–1000 Mhz, although it will be appreciated by one of ordinary skill in the art that the antenna can be constructed so as to operate at other frequency ranges.

Figure 1B:
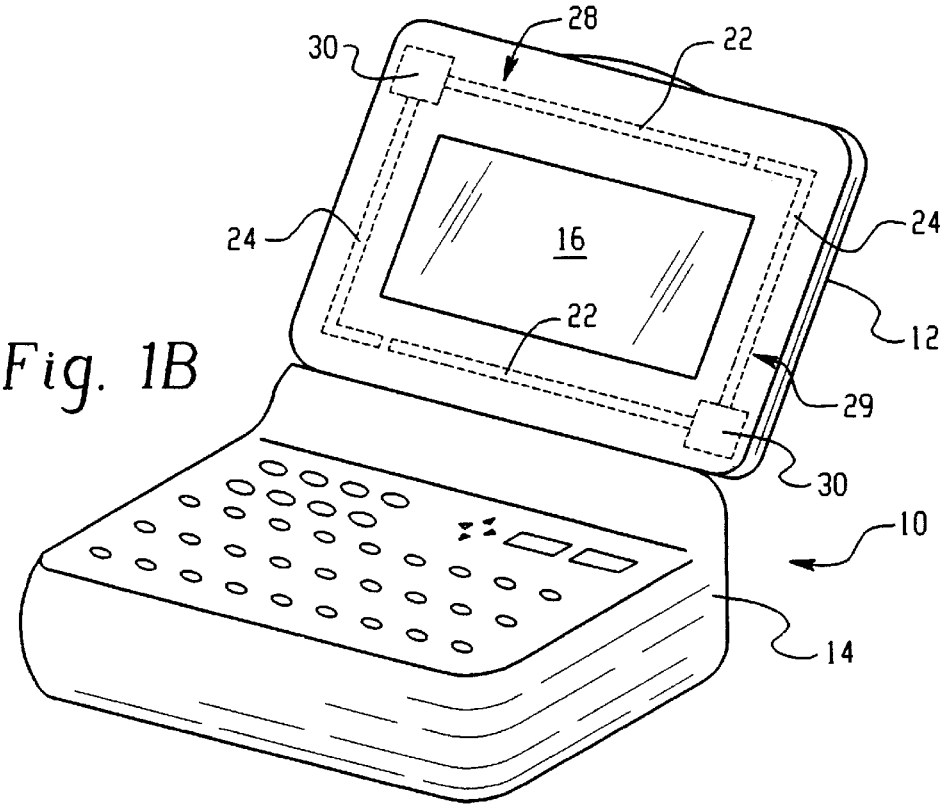
FIG. 1*b* shows an alternative embodiment of a hand-held data communications device having dual antennas as according to the present invention.

FIG. 1*a* shows, by way of example of the preferred embodiment of the invention, a device 10, such as a pager, incorporating an antenna as according to the present invention. In its preferred embodiment, the device includes a lid 12 and a body 14. The lid 12 preferably includes an LCD display 16 for displaying both incoming and outgoing alphanumeric data. The body 14 receives and retains the electronic components that process the device signal and provide other device functions. Antenna 20 is preferably incorporated into the device lid 14 and thus hidden from view. FIG. 1*b* shows two antennas 28 and 29 in a configuration designed for either simultaneous transmission and reception of data or to reduce the design requirements imposed by a single antenna structure.

Figure 2:
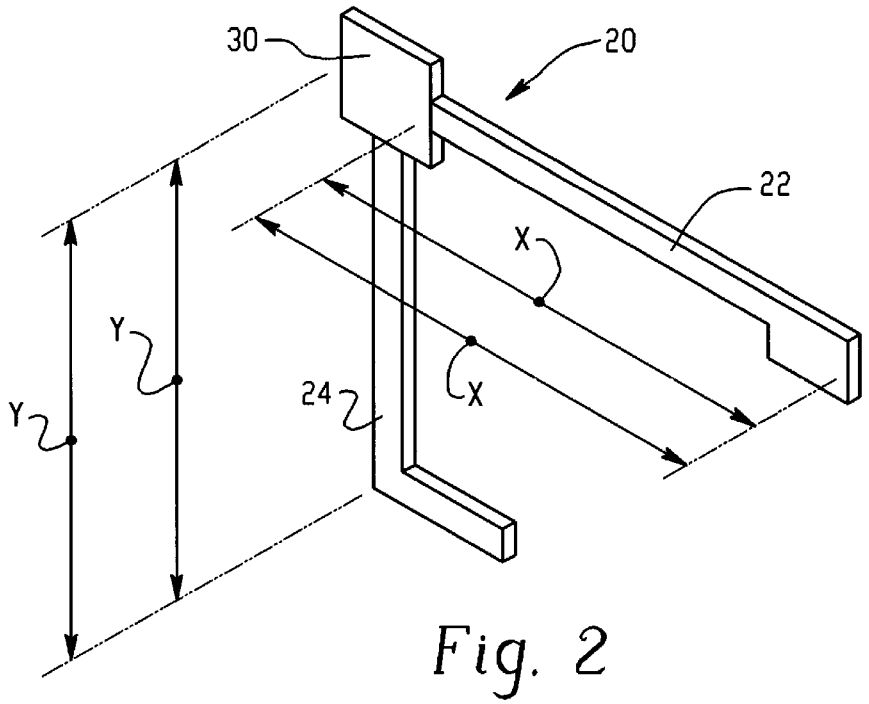
FIG. 2 illustrates the configuration and operation of the antenna of the present invention.

As shown in FIGS. 1*a,* 1*b* and 2, the preferred construction of antenna 20 is a dipole formed of a horizontal arm 22 and a vertical arm 24 for receiving the signal in each of the vertical and horizontal polarization planes. The respective dipole arms 22, 24 are sized to fit within the device lid 12, and in the case of the dual antenna configuration, are placed in such a manner that each antenna 28 and 29 is conductively isolated from the other. The arms 22, 24 are preferably made of copper and have a thickness of about 0.0025" on a 0.001" Kapton material substrate. The horizontal arm 22 is preferably about 2.04" in length with an extending portion of about 0.54". The vertical arm 24 is preferably about 2.17" long, with a lower portion about 1.19" in length. In the preferred embodiment, the horizontal arm and the vertical arm are substantially orthogonal, i.e. they form a substantially 90° angle. As one of ordinary skill in the art will appreciate, however, the position of the arms need only to be at an angle such that the two arms are not in the same line. Since antenna 20 is two-dimensional in shape, it can transmit and receive signals in both planes of polarization (as shown in FIG. 2), thus enabling a device, such as a device to be less sensitive to tilting and orientation and to provide excellent in-building performance. The preferred construction of dipole antenna 20 results in a gain of about 0 dB at 900 MHz, at least a 5 dB improvement in gain over the previous loop-type antenna frequently used in pagers.

Figure 3:
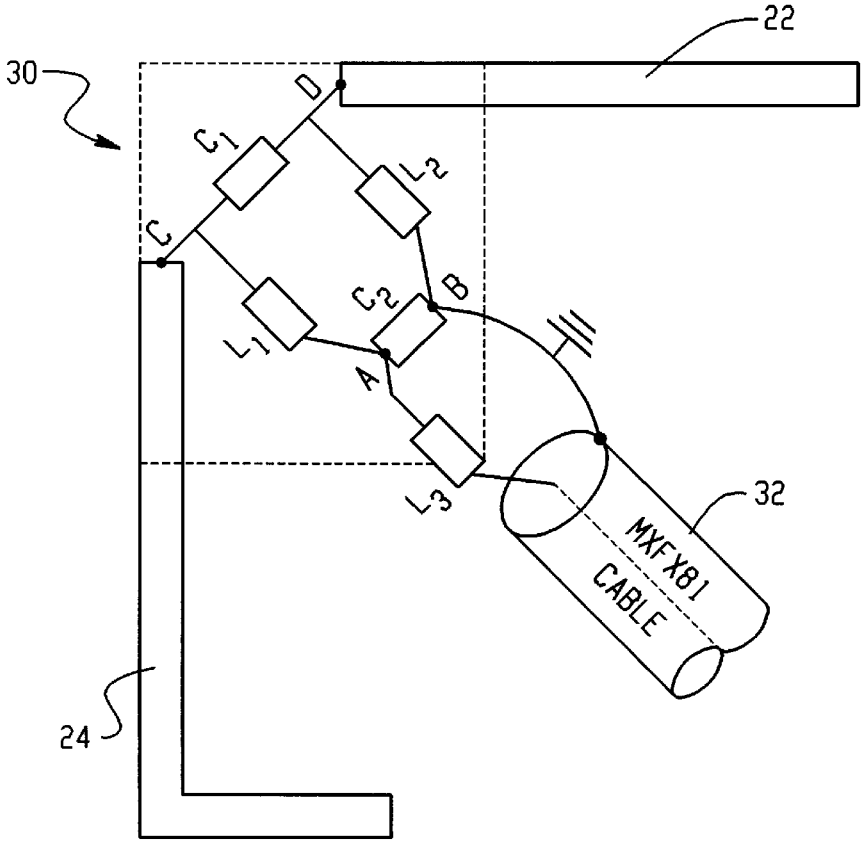
FIG. 3 shows the detail of the matching circuit as according to the present invention.

In a single antenna configuration, the data signal is reciprocally processed through an LC lumped matching circuit 30, as shown in FIG. 3, that preferably includes capacitors (C1, C2) and inductors (L1, L2, L3) for connecting the dipole arms 22, 24 to a coaxial cable within the device body 14. In the preferred embodiment for operating in the 900 Mhz frequency range, C1=4.3 pF, C2=7.5pF, L1=L2 =3.9 nH and L3=4.7 nH; the coaxial cable is a MXFX81 cable and display 16, which also can affect the values of C1, C2, L1, L2 and L3, is preferably a FSTN LCD available from Varitronix, Hong Kong as part no. CRUS 1024-V05. For any given data communications device, the internal impedance of the device can be directly measured and the values for C1, C2, L1, L2 and L3 can be calculated empirically from that measurement. LC circuit 30 provides transformer action, matching action and balancing action, as will be shown subsequently.

LC circuit 30 provides an impedance to antenna 20 to match the 50 ohm impedance of the RF device contained within device body 14. This impedance matching reduces currents induced on the device components by the presence of a human operator and various ground plane conditions, thereby improving the gain of the device.

The present matching circuit also provides a transformer action wherein the signal energy is proportioned between each of the arms. In a transmission mode, an RF signal is fed through a coaxial cable 32 into the circuit 30 where it is split into each of the arms 22, 24 where the signal is transformed to electromagnetic radiation which propagates through the air. In the receiving mode, the matching circuit 30 combines the signals received and transforms the RF signal to a detectable level. The detectable signal then travels through the coaxial cable to the RF data communications device.

The performance of the present antenna is greatly facilitated by the coupling between the dipole arms 22, 24. Applicants have discovered that the presence of an anisotropic medium in proximity with the antenna is effective at controlling the electrical environment within the device and affecting the propagation vector of the antenna. The liquid crystal material in the present LCD 16 is anisotropic, and as applicants have discovered, its anisotropic nature provides the desired coupling properties. As used herein, the present "coupling" is analogous to the mutual inductance in a transformer, where electromagnetic energy propagates across a pair of the inductors in respective resonating circuits.

By carefully positioning the two dipole arms, the feed cable and the LCD 16, applicants have discovered that the two dipole arms 22, 24 can be electromagnetically coupled as are the inductors in a transformer. The anisotropic material of the LCD 16 creates a non-uniform electric field effectively splitting the signal transmitted and received from each dipole element into perpendicular components. The signal propagated from the horizontal dipole 22 propagates in a horizontal polarization. However, a portion of the signal propagating through the LCD 16 is transformed into the vertical polarization, so that the original polarized wave is effectively split into waves having vertical and horizontal polarization. Similarly, the polarized signal propagating from the vertical dipole 24 is split into perpendicular components. The electromagnetic coupling through the LCD 16 is such that each of these respective perpendicular components reinforce each other in phase, so that constructive wave fronts are produced for each polarization. In this way, each of the respective dipoles 22, 24 are electromagnetically coupled.

Figure 4A:
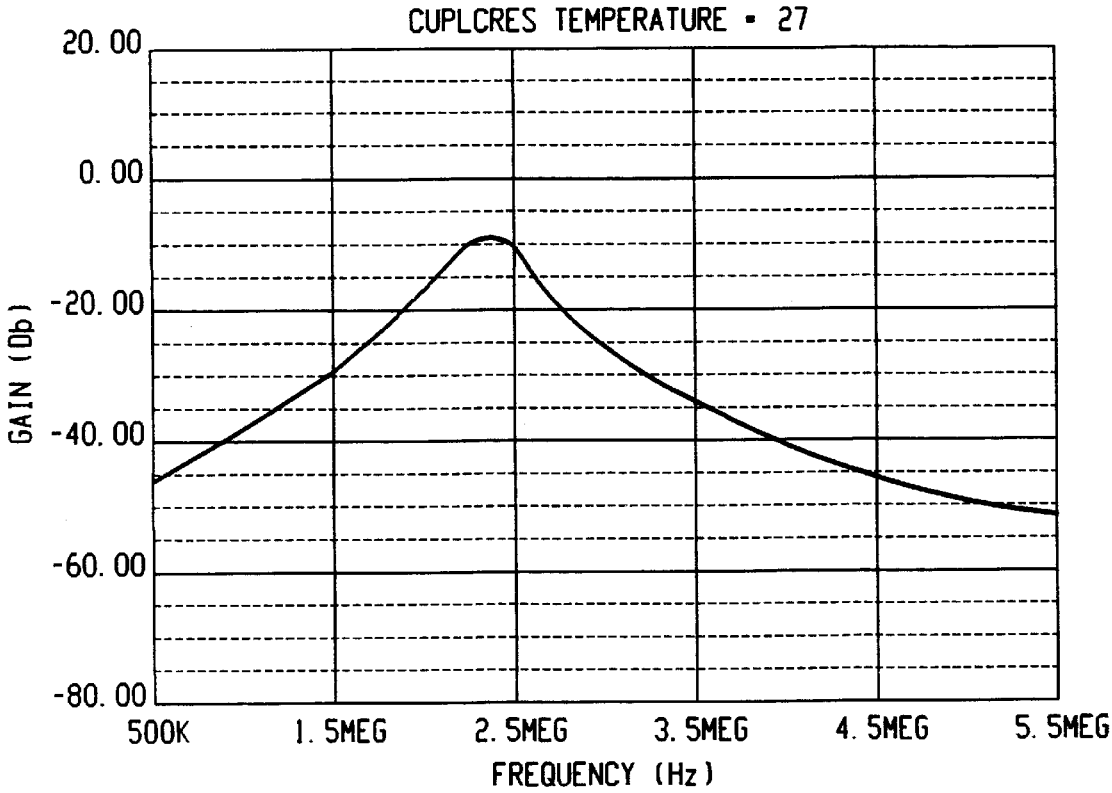
FIGS. 4A and 4B show respectively the amplitude and spatial response for an under-coupled and critically-coupled dipole antenna, as according to the present invention.
Figure 4B:
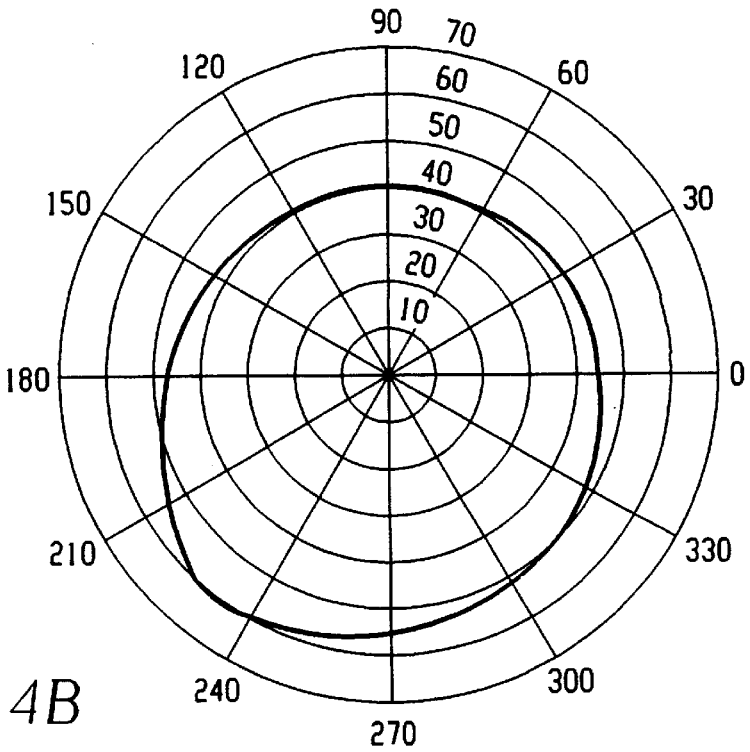

Under-coupling of the dipoles occurs when the mutual effects of each dipole element on the respective other produce a single resonant amplitude peak. Critical coupling results in a single resonant mode with maximum amplitude about a central frequency. The resonant response of under-coupled and critically-coupled antennas is shown in FIG. 4A. These couplings also result in a spatial amplitude peak as shown in FIG. 4B., in which antenna gain peaks around 230 degrees (where zero is the forward facing direction of the user.)

Figure 5A:
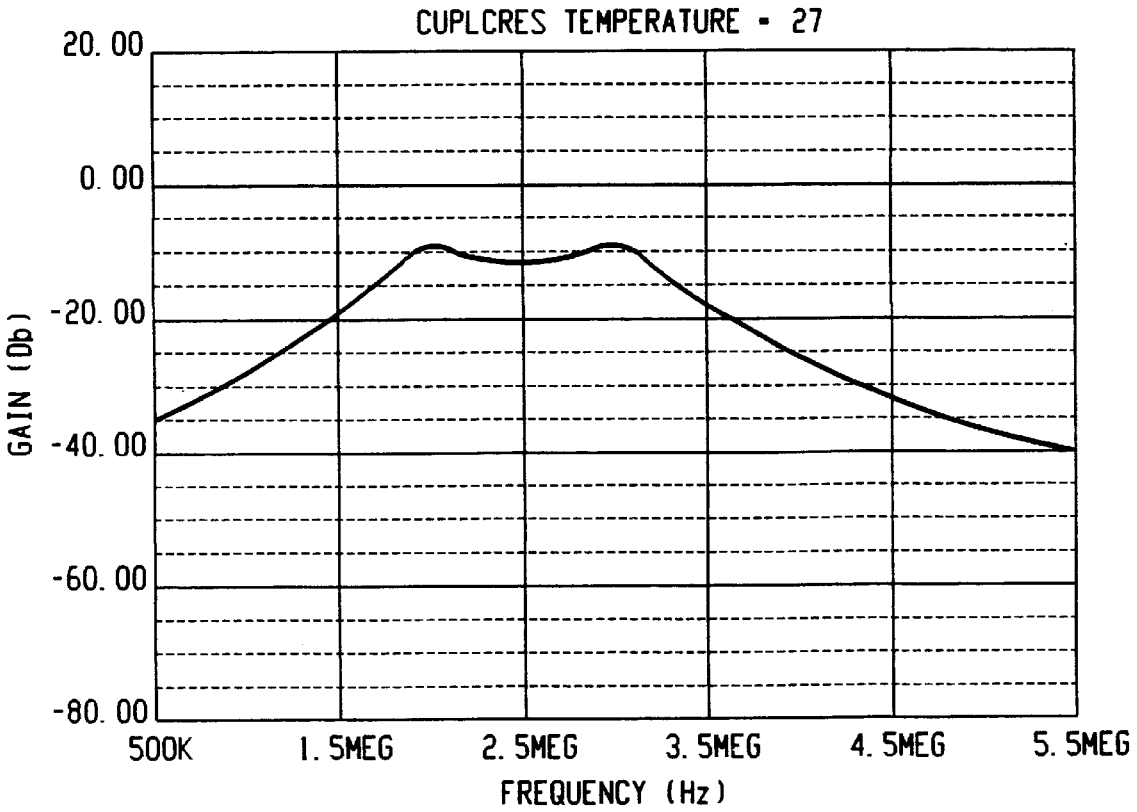
FIGS. 5A and 5B show respectively the amplitude and spatial response for an over-coupled dipole antenna, as according to the present invention.
Figure 5B:
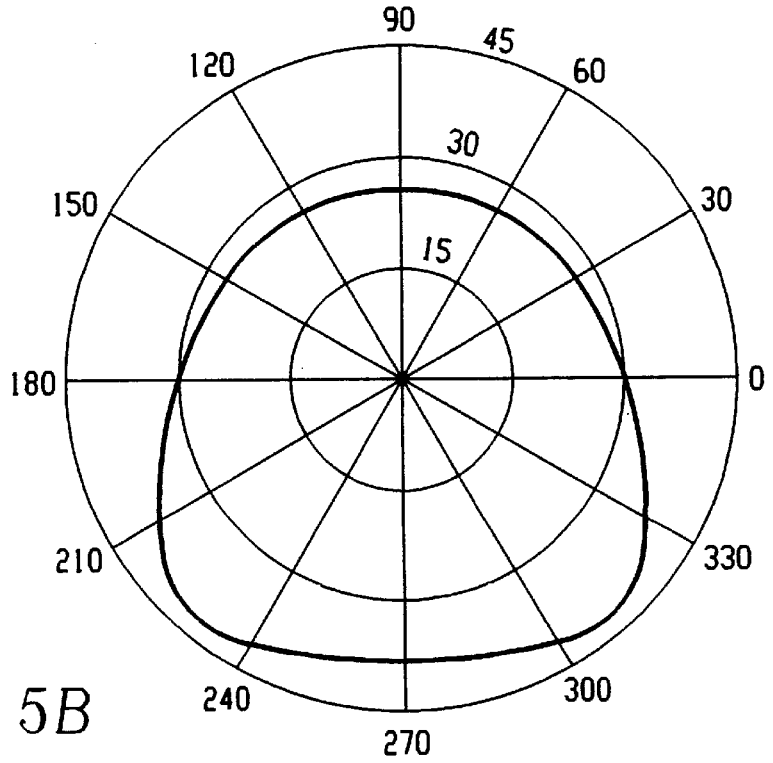

Antenna performance as according to the preferred embodiment occurs when coupling is further increased so that the dipole becomes overcoupled. The resonant amplitude of an overcoupled dipole resonates at two peak frequencies of equal amplitude, with respective peaks representing the symmetrical and antisymmetrical modes centered about a desired base frequency, as shown in FIG. 5A. This results in an effectively broadened resonant frequency bandwidth. Also, the frequency peaks are birefringent, i.e., each has a propagation vector perpendicular to the other. The overcoupled dipole thus propagates two perpendicular signals differing only slightly in resonant symmetrical and antisymmetrical frequency. The result is an antenna with a broadened effective bandwidth in both polarizations, thus increasing the antenna gain. The overcoupled dipole also resonates with two spatial amplitude peaks, as seen in FIG. 5B. The gain is thus higher over a larger perimeter of the user, and therefore the present antenna is less sensitive to directional variations in gain.

Dipole 20 and matching circuit 30 cooperate to enable a two-way RF data communications device that is stable and insensitive against antenna detuning in the ambient environment. Antenna detuning can occur from, among many causes, parasitic capacitance and adverse ground plane conditions. Also, the present invention is insensitive to directional orientation and signal deflections within buildings. The present invention offers at least a 5 dB improvement in gain over previous loop antennas and at least a 3 db improvement in gain over patch antennas used in hand-held data communications devices and an operative bandwidth at about 10% as compared with 1–2% for other one-way devices and ½% for other two-way devices.

Figure 6A:
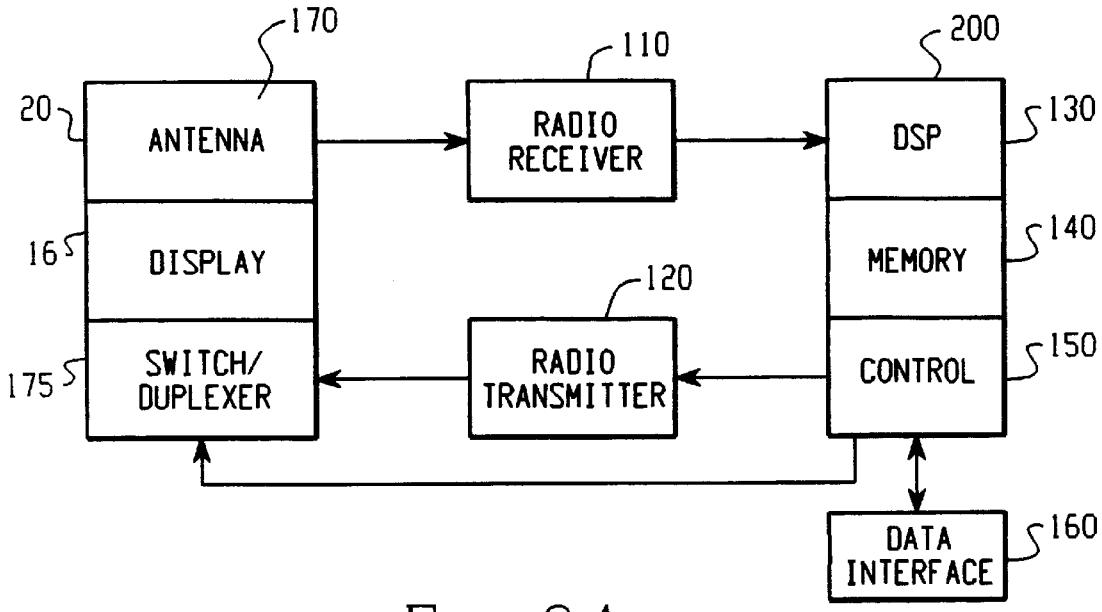
FIGS. 6A and 6B show respectively a single antenna and dual antenna configuration of an RF data communications device incorporating the present invention.
Figure 6B:
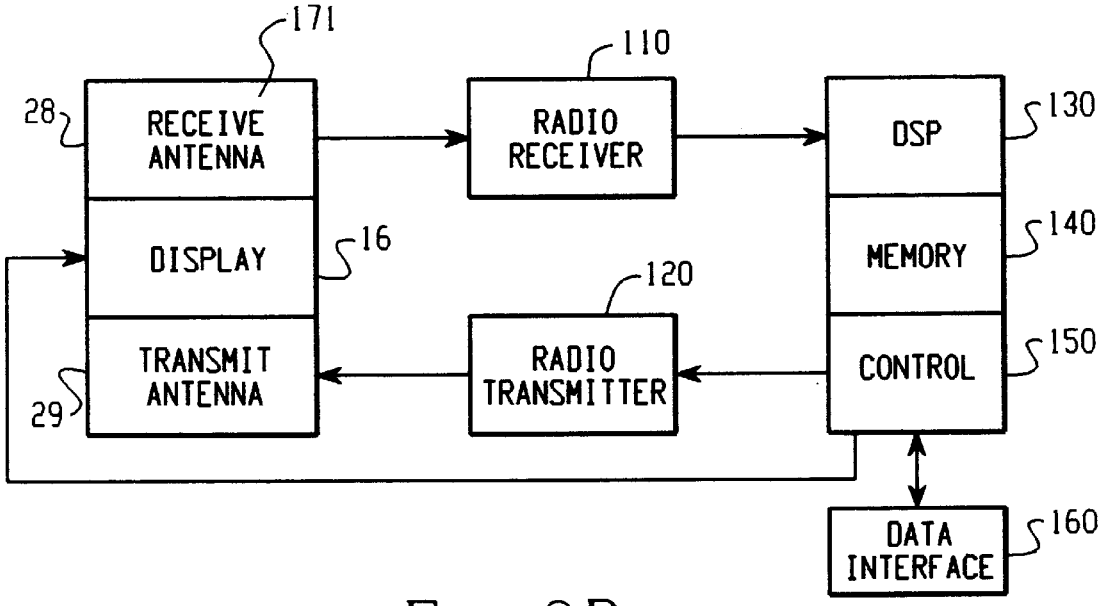

Turning now to FIGS. 6A and 6B, shown are two implementations of the invention in conjunction with an RF data communications device. FIG. 6A shows a simple block diagram of an RF data communications device, such as a pager, which incorporates the instant invention. Such a device would include a control subsystem 200 comprising a DSP 130, memory 140 and control 150; a radio receiver 110 and a radio transmitter 120; and the antenna system 170 of the instant invention comprising a dipole antenna 20 in conjunction with a matching circuit, and LCD display 16 that, as discussed above, serves the dual function of displaying data as a part of data interface 160 and as an anisotropic medium for electromagnetic coupling of the signals radiating from the arms of the dipole antenna 20. Switch/Duplexer 175 represents the element that places the antenna system 170 in either a transmit or receive mode. Although shown as part of antenna system 20, switch/duplexer 175 could just as easily be represented and configured as an element that functions outside antenna system 20, but operatively connected to it. FIG. 7A, discussed in greater detail below, illustrates the placement of the switch/duplexer 175 outside the antenna subsystem. Additionally, the function that switch/duplexer 175 performs could be performed with a electronic, software or mechanical switch, or a duplexer or by any means by which different data streams, one in-bound and one out-bound can be separated and either transmitted or received, as relevant, over the dipole antenna 20.

FIG. 6B differs from FIG. 6A only in its use of a dual antenna system 171. Receive antenna 28 and transmit antenna 29 replace the single dipole antenna 20 to enable the RF data communications device to transmit and receive simultaneously or to reduce the design requirements associated with a single antenna configuration. This configuration eliminates the need for the switch/duplexer 175 found in FIG. 6, because each mode is accommodated by a separate antenna in this configuration.

FIGS. 7A and 7B are more detailed versions of the RF communications devices shown in FIGS. 6A and 6B, respectively. Antenna 20 and Display 16 are represented in Antenna/Display Subsystem 600. Radio Receiver 110 is represented by items 111–117, IQ demodulator 118, auxiliary local oscillator synthesizer 119 and local oscillator synthesizer 200, which Radio Receiver 110 shares with Radio Transmitter 120. Radio Transmitter 120 includes items 311–314, 321–324, 330–336, clock circuit 210, and local oscillator synthesizer 200, which it shares with Radio Receiver 110. Memory 140 is represented by flash RAM 141 and SRAM 142. Control 150 is represented by microprocessor 500 in conjunction with control line 151. Data Interface is represented by serial line 161 in conjunction with microprocessor 500. As previously mentioned, display 16 could also be consider part of the data interface 160. Additionally, any input device, such as a keyboard, mouse, touchscreen, etc., would be considered part of data interface 160.

In addition to the above items, FIGS. 7A and 7B illustrate other components of the RF data communications device. Items 601 and 602 represent the circuitry for processing data from Battery Voltage Sensor 603. Items 701 and 702 represent the circuitry for processing data from Temperature Sensor 703. Also included in the device is Power Management Circuitry 100.

FIG. 7B differs from FIG. 7A only in that it includes a dual antenna configuration represented by Receive Antenna 28 and Transmit Antenna 29. As a result, switch/duplexer 175 comprising T/R switch 176 is no longer needed. It should be noted, however, that because the receive circuit and the transmit circuit share Local Oscillator Synthesizer 200, it is not possible for this device to utilize the dual antenna structure to transmit and receive simultaneously. By replicating the functions that are share by including an additional local oscillator synthesizer, one can easily see that the use of dual antennas would enable, in that instance, simultaneous transmission and reception.

As described above, the present invention solves many problems associated with previous antennas used with RF data transmission and presents improved efficiency and operability. Although the preferred embodiment of the invention has been described in reference to a pager, the invention has applicability to any device that has the need for an antenna system that solves many problems found in prior art antennas. Without limiting the generality of the instant invention, it should be noted that among the devices to which the antenna system of the instant invention can be applied are notebook computers, combined cell phones and pagers, PDA's, PIM's and other personal data devices including those worn on the wrist, in conjunction with eyeglasses or as a belt around the body. Additionally, it will be appreciated that various changes in the details, materials and arrangements of parts which have been herein described and illustrated in order to explain the nature of the invention may be made by those skilled in the art within the principle and scope of the invention as expressed in the appended claims.

We claim:

1. An antenna system for enhancing the performance of an RF data communications device comprising:

a dipole antenna having a first arm extending in a first direction and a second arm extending in a second direction that is not in the same line as the first direction;

an electromagnetic coupler comprising an anisotropic medium placed substantially adjacent to the dipole antenna; and an impedance matching circuit including at least one capacitor element and at least one inductor element, wherein the matching circuit matches the impedance of the RF data communications device to which the dipole antenna is operatively connected, and operating in conjunction with the electromagnetic coupler, balances an RF signal of interest between the first arm and the second arm, thereby establishing a desired resonant bandwidth for operating the RF data communications device.

2. The antenna system of claim 1 wherein the anisotropic medium comprises a liquid crystal display.

3. The antenna system of claim 1 wherein the matching circuit is a lumped L.C. circuit.

4. The antenna system of claim 3 wherein the values of each inductor and each capacitor are selected to provide impedance matching and a balanced to unbalanced transformation between the dipole antenna and the RF data communications device.

5. The antenna system of claim 1, wherein the dipole antenna is a first dipole and wherein the antenna system further comprises a second dipole placed substantially adjacent to the first dipole and to the electromagnetic coupler.

6. An RF data communications device with improved antenna performance comprising:

a data interface;

a radio receiver and a radio transmitter, wherein the data interface, radio receiver and radio transmitter are connected through a microprocessor; and an antenna system, wherein the antenna system comprises:

a dipole antenna having a first arm extending in a first direction and a second arm extending in a second direction that is not in the same line as the first direction; and an electromagnetic coupler comprising an anisotropic medium placed substantially adjacent to the dipole antenna; and an impedance matching circuit including at least one capacitor clement and at least one inductor element, wherein the matching circuit matches the impedance of the dipole antenna to the RF data communications device to which the dipole antenna is operatively connected, and operating in conjunction with the electromagnetic coupler, balances an RF signal of interest between the first arm and the second arm, thereby establishing a desired resonant bandwidth for operating the RF data communications device.

7. The RF data communications device of claim 6, further comprising a transmit/receive switch, wherein the switch switches the mode of the antenna system from transmission to reception and from reception to transmission, the dipole antenna is used for transmitting when the switch has switched the mode of the antenna system to transmission and the dipole is used for receiving when the switch has switched the mode of the antenna system to reception.

8. The RF data communications device of claim 7, wherein the transmit/receive switch is a duplexer.

9. The RF data communications device of claim 6, wherein the dipole antenna is a first dipole and wherein the antenna system further comprises a second dipole placed substantially adjacent to the first dipole and to the electromagnetic coupler.

10. The RF data communications device of claim 9, wherein RF signal reception occurs through the first dipole and RF signal transmission occurs through the second dipole.

11. A method of enhancing performance of an antenna associated with an RF data communications device comprising the steps of:

placing an anisotropic medium between a first arm and a second arm of a dipole antenna;

electromagnetically coupling the anisotropic medium and the dipole antenna so as to split signals radiating from each dipole antenna arm into orthogonal components matching the impedance of the dipole antenna to the RF data communications device to which the dipole antenna is operatively connected, wherein the electromagnetically coupling step and the matching step result in balancing signal strength between the first arm and the second arm, thereby establishing a desired resonant bandwidth for operating the RF data communications device.

12. The method of claim 11 further including the step of choosing values of at least inductor and at least one capacitor so as to complete the matching step and enable a balanced to unbalanced transformation between the dipole antenna and the RF data communications device.

* * * * *